US006143093A

United States Patent [19]

Schultz

[11] Patent Number: 6,143,093

[45] Date of Patent: Nov. 7, 2000

[54] SANITARY SPILLED LIQUID DISPOSAL DEVICE

[76] Inventor: Richard B. Schultz, 401 Hallmark Cir., Belton, Tex. 76513

[21] Appl. No.: 09/431,685

[22] Filed: Nov. 1, 1999

[51] Int. Cl.[7] ..... B08B 5/04; A47L 9/06

[52] U.S. Cl. ..... 134/21; 15/393; 15/396; 15/415.1

[58] Field of Search ..... 15/393, 394, 415.1, 15/396; 134/21

[56] References Cited

U.S. PATENT DOCUMENTS

| | | | |
|---|---|---|---|
| 1,575,939 | 3/1926 | Satterwhite et al. | 15/393 |
| 1,601,774 | 10/1926 | Scheffer | 15/415.1 |
| 2,064,903 | 12/1936 | Ghignatti | 15/396 |
| 2,206,738 | 7/1940 | Brock et al. | 15/396 |
| 2,240,005 | 4/1941 | Moyer | 15/393 |
| 2,606,338 | 8/1952 | De Lorenzo | 15/396 |
| 3,268,933 | 8/1966 | Marantette et al. | 15/1.7 |
| 3,281,885 | 11/1966 | Hersh | 15/393 |
| 4,351,081 | 9/1982 | Tarkinson | 15/320 |
| 5,014,389 | 5/1991 | Ogilvie et al. | 15/353 |
| 5,134,748 | 8/1992 | Lynn | 15/393 |
| 5,349,722 | 9/1994 | Chayer | 15/353 |
| 5,692,263 | 12/1997 | Sorenson | 15/415.1 |
| 5,720,078 | 2/1998 | Heintz | 15/415.1 |
| 5,743,674 | 4/1998 | Healy | 405/52 |
| 5,830,281 | 11/1998 | Kliewer et al. | 15/210.1 |

*Primary Examiner*—Robert J. Warden, Sr.
*Assistant Examiner*—Theresa T. Snider
*Attorney, Agent, or Firm*—George R. Schultz; Madan, Mossman, Schultz & Sriram

[57] ABSTRACT

A device and method is provided for sanitarily removing a spill from a horizontal surface employing a flexible inner-tube with radial circumferential holes and covered by an absorbent material with outwardly facing strips for securing the device to the horizontal surface.

23 Claims, 2 Drawing Sheets

SANITARY SPILLED LIQUID DISPOSAL DEVICE

TECHNICAL FIELD OF THE INVENTION

The field of the invention is the sanitary containment of liquid spills on a floor in such hazards environments as an operating room.

PRIOR ART

In an operating room environment, often times there is a need to contain spills of many liters of fluid. This fluid has usually been in contact with the patient so that a biohazard results. A need exists for a disposable device which can be used to contain and remove the spilled liquid without causing a hazard during surgical operations. Additionally, a need exists for a disposable device to aid in complete removal of the fluid after the surgical procedure. Moreover, a need exists for an expandable liquid disposal device which can be used to contain spills of various sizes without the need for modification during surgery.

Several prior art devices have attempted to solve these problems, but have not been completely successful.

U.S. Pat. No. 5,014,389 to Ogilvie is one example. One problem with the Ogilvie device is that it only slides easily if sitting on a significant layer of liquid. Once it has evacuated the liquid directly underneath it, it is fairly well fixed to the floor. The operator generally has to grab the suction tube coming out of the top of it to move it to a new location. Further, the device is hard to move because of its geometry. Further, if the operator attempts to push the device by placing a foot on top of it, the problem of sticking to the floor is exacerbated. Another problem is that the Ogilvie device only removes a spill in one localized area. Since fluid is often ejected in all directions from its source during surgical procedures, the local effect of the Ogilvie device is inadequate to clear all of the spill. For the same reason, the Ogilvie device also performs poorly with large volumes of liquid. But, this is also the worst time to require a nurse to vacuum up the spill because he/she is needed to actually take care of the patient's/surgeon's needs during the case. If the device is positioned more closely to the point source of the spill to increase its effect, it is in the way of the operating team and becomes a tripping risk.

The device discussed in U.S. Pat. No. 5,743,674 to Healy is designed to be permanently fixed to the floor. A fixed system would not be reasonable in an environment requiring multiple changes of the device daily and would present an increased tripping hazard. Further, a fixed device creates the risk of biohazard contamination. If the device was not fixed to the floor, there is no provision for dealing with the liquid that would escape below the device. Also this device requires a specific orientation and care in connecting the corners to effectively contain a spill. Further, the geometry of the device severely limits its ability to bend into a circle and remain effective. Another problem with the Healy device is that the amount or volume of spill that could be handled by this device is fixed. In the operating room these spills can range from 1–30 liters of fluid, creating a variable spill that could not be accommodated efficiently by the Healy device.

U.S. Pat. No. 5,720,078 to Heintz has the problems of being ineffective on large spills because of its localized effect. Further, since the Heintz device must be underfoot to be effective, it creates a substantial tripping risk. Similarly, one of the stated advantages of U.S. Pat. No. 5,349,722 to Chayer is the capability to lock the suction head in place.

However, an immovable object in the operating room creates a significant tripping risk.

The current invention overcomes the limitations of the prior art by providing a device and method for removing liquid from an operating room floor which can be configured to fit various shapes, presents little or no tripping hazard and which can be expanded to cover almost any spill rate. Further, the device is disposable thereby eliminating the possibility of biohazard contamination. The preferred embodiment consists of a flexible plastic tube with small holes every few inches in its outer wall. The tube is surrounded by a felt sleeve with strips of adhesive placed at intervals on the outside surface. The felt sleeve in the preferred embodiment is a light color so that the use of the device can be easily identified. During use a desired length of the device is cut from an extended roll and one end is connected to a vacuum source while the other end is plugged. The device is placed on the floor around the perimeter of the spill so that the spill is "wicked" into the felt sleeve, drawn into the tube through the holes and removed by the vacuum. Additionally, a method is provided whereby the device may be drawn into circles of ever-decreasing size to completely eliminate spills after an operation. Further, a method is provided where spills of various sizes may be quickly and easily disposed of by using multiple rings or passes of the device to increase its spill rate removal capacity.

DETAILED DESCRIPTION OF PREFERRED EMBODIMENT

Figure 1:
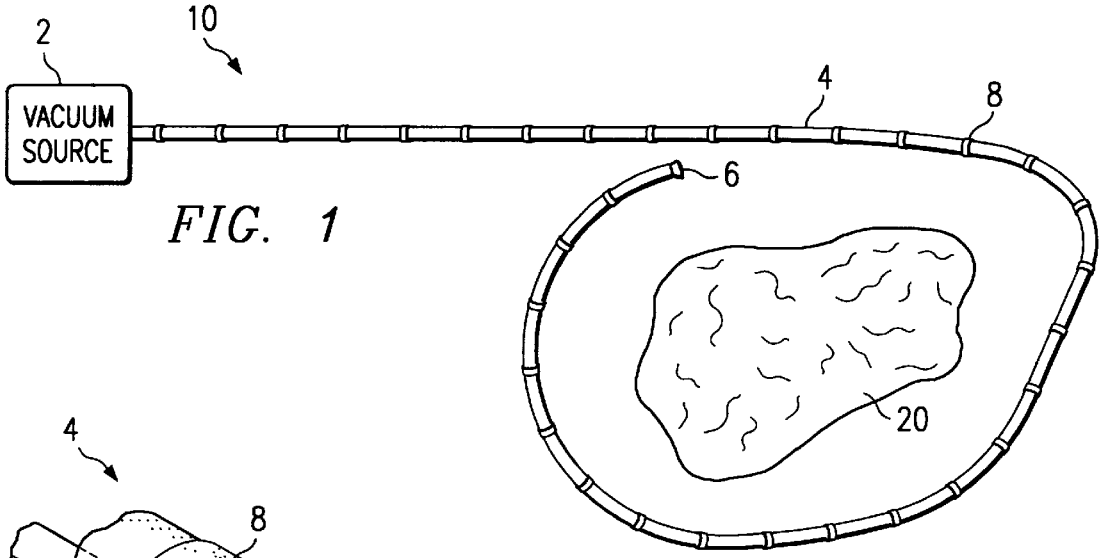
FIG. 1 depicts a schematic diagram of the present invention connected to a vacuum source and placed in a circular, flexible pattern around a spill.

Referring to FIG. 1, the system 10 for sanitary removal of a spilled liquid is shown. The system 10 requires a vacuum source 2 including a biohazard removal trap which is often located in hospital operating rooms but can also be independently supplied. This type of vacuum source is well known in the art will not be further described. FIG. 1 shows the flexible pick up tube 4 wound in a circumferential pattern around a spill 20. Also shown in FIG. 1 are adhesive strips 8 placed along the outer circumference of the pick up tube 4. The adhesive faces outward. In practice, the adhesive allows the pick up tube to be easily removably secured around any spill, furniture or personnel without the need for extensive contact by the hands. The adhesive holds the pick up tube firmly but removably to the floor in any desired configuration. Any tripping hazard from the device is reduced by the fact the pick up tube 4 is held firmly to the floor by adhesive strips 8. FIG. 1 also shows plug 6 which is placed in the end of pick up tube 4 to prevent the escape of the vacuum from the vacuum source.

Figure 2A:
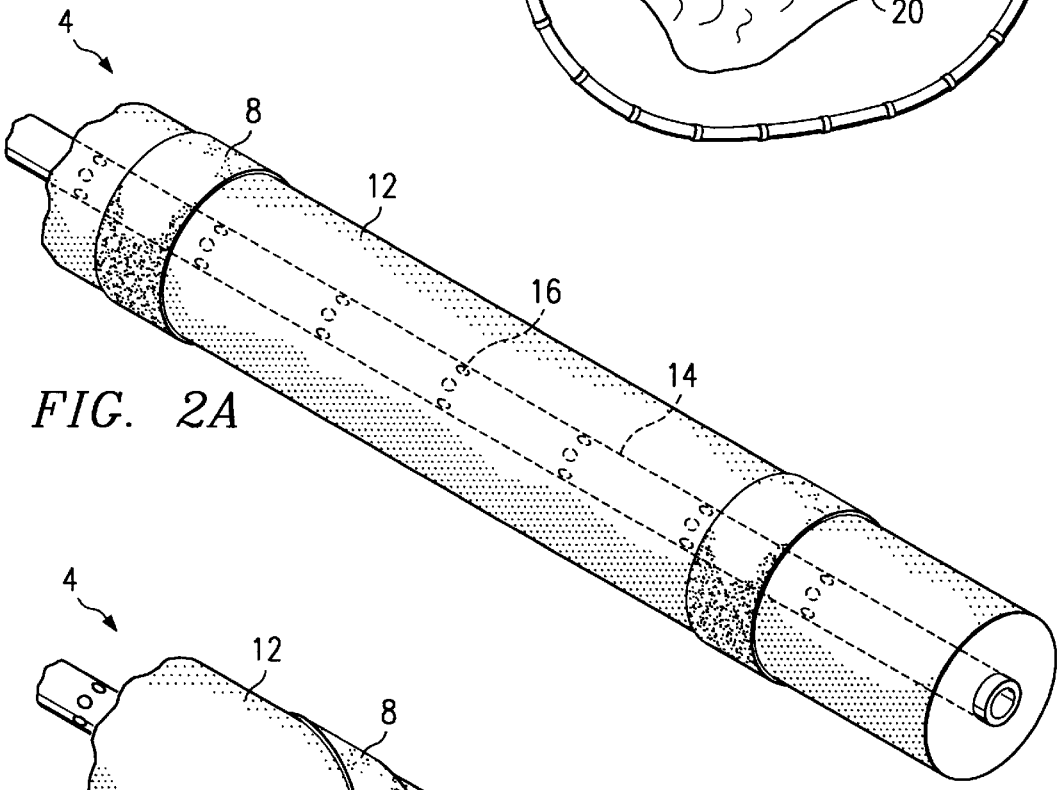
FIG. 2*a* shows a cross-sectional view of one embodiment of the present invention.
Figure 2B:
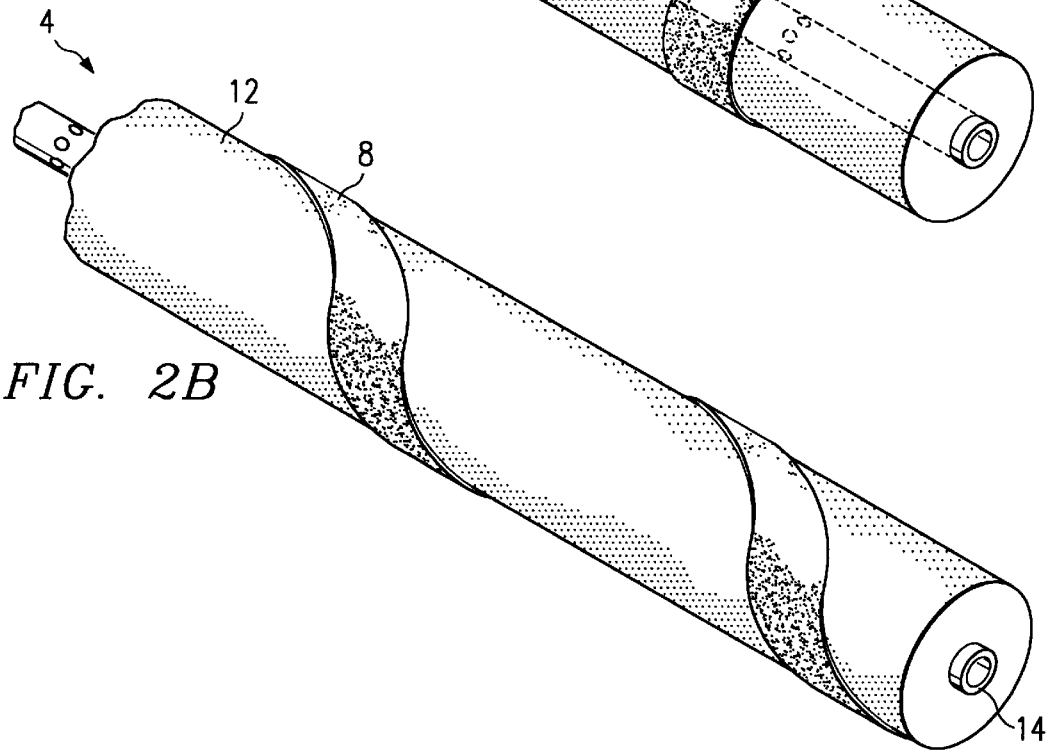
FIG. 2*b* shows a cross-sectional view of a second embodiment of the present invention.

Referring now to FIG. 2, the preferred embodiment of pick up tube 4 is shown in cut-away detail. Pick up tube 4 can be seen to consist of a felt sleeve 12 surrounding a flexible tube 14. In the preferred embodiment the flexible tube consists of 0.25" clear plastic tubing and the felt sleeve is a white or light colored absorbent woven material. The light color enables the operator to easily determine at a glance if the device has been used or soiled before or after a surgical procedure. The light color also reduces the tripping risk by drawing attention to the presence of the device. In another embodiment, the felt sleeve can be replaced by a sleeve made of a disposable paper product or other porous absorbent material, such as cotton or fabric mesh. Flexible tube 14 is provided with radial circumferential perforations 16 approximately every 4–6" along its length. Additionally, adhesive strips 8 are shown on the outside of felt sleeve 12. It is important to note that the "sticky" portion of the adhesive strip faces outward on the device.

In order to operate the device, one end of the flexible tube is connected to a vacuum source and a plug is placed in the other end. The vacuum is translated to the circumferential perforations of the flexible tube. When placed next to a spill, liquid is "wicked" into the felt sleeve and then removed through the circumferential perforations, down the flexible tube and into the vacuum source. The radial nature of the perforations allows the device 4 to be placed in any orientation without regard to the axis of the flexible tube. In practice, this means that when the device is unrolled and placed on a floor, it does not have to be oriented toward or away from the spill in order to perform its function of removing the spill.

In other embodiments, the adhesive 8 can take on other geometries rather than being perfectly circumferential. For instance, as shown in FIG. 2-A the adhesive strips 8 can be helical or linear (not shown), parallel to the axis of flexible tube 14 or sprayed onto the outside of the felt sleeve in a random pattern.

In other embodiment, plug 6 may be formed by "doubling" back a section of the pick up tube 4 against itself where the adhesive strips are used to maintain the closure formed by the fold in pick up tube 4.

In practice, the device is stored on a large dispensing roll inside a plastic sterile storage container. A desired length is then pulled from the roll and cut off. One end of the hose is fitted to the vacuum source while the other end is plugged. The device is then placed around the spill to be contained, pressed into place and the vacuum source activated.

Figure 3:
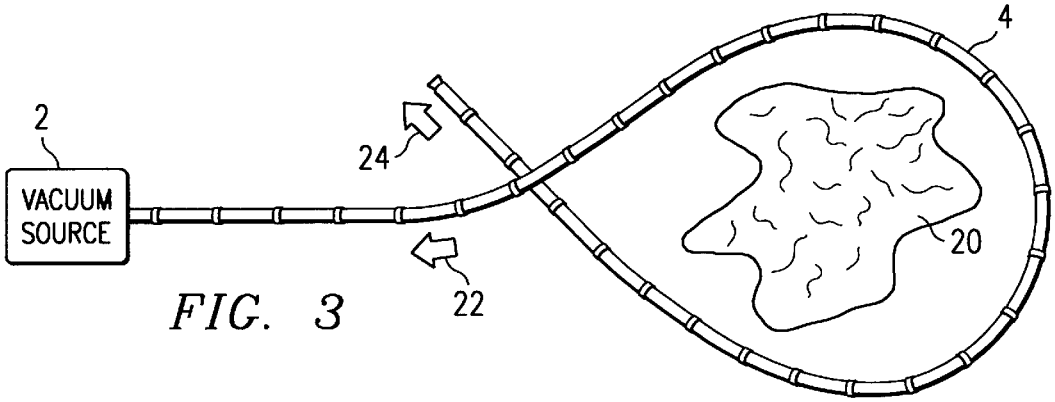
FIG. 3 shows a method of cleaning an entire spill using the device.

FIG. 3 shows a method of completely removing a spill with the pick up tube 4. After a surgical operation the amount of the spill which has not been removed by the device must be completely cleaned. The device can perform this function easily by drawing it into ever-decreasing circles by pulling in opposite directions on the ends of the device shown as 24 and 22. After this procedure, the device is disconnected from the vacuum source 2 and disposed of.

Figure 4:
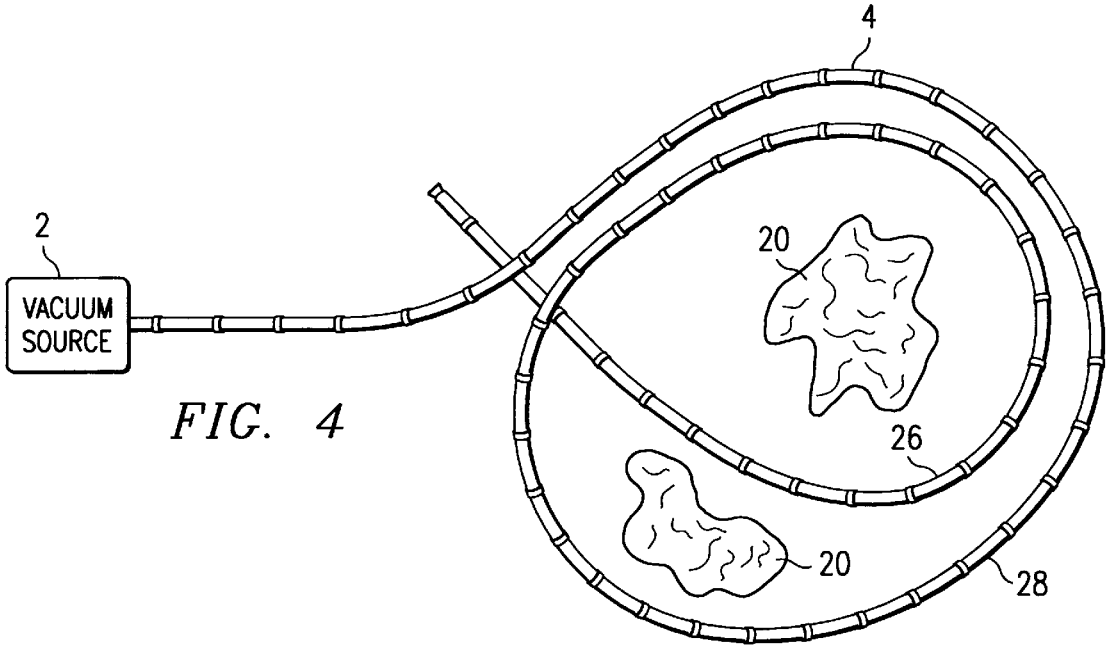
FIG. 4 shows a method of containing spills of various sizes and locations with the device.

FIG. 4 shows a method of containing large spills or spills with a large flow rate. In this method, a long length of the device 4 is placed in concentric circles around spill 20. A spill which escapes the interior circle will not escape the exterior circle, shown as FIGS. 26 and 28. This method can be expanded into more circle of device 4 as the amount of liquid to remove increases, or the area to be cleaned becomes larger.

The foregoing disclosure and description of the invention are illustrative and explanatory thereof and various size, shape, materials, and components may be made without departing from the spirit of the invention.

I claim:

1. A device for removing a fluid from a surface comprising:

a. A flexible inner tube with two ends having a plurality of perforations along its length, connected to a vacuum source at one of the ends;

b. An absorbent sleeve surrounding the inner tube and having adhesive portions on the outer surface thereof for contact with a surface;

c. A closure at the end of the tube not connected to the vacuum source;

d. The vacuum source capable of drawing fluid into the sleeve and through the inner tube for removal from the surface.

2. The device of claim 1 wherein the flexible inner tube is made of plastic.

3. The device of claim 1 wherein the absorbent sleeve is a felt material.

4. The device of claim 1 wherein the absorbent sleeve is a disposable paper product.

5. The device of claim 1 wherein the closure is a plug.

6. The device of claim 1 wherein the closure is created by folding the inner tube back onto itself and securing it.

7. The device of claim 1 wherein the adhesive portions are placed in a series of spaced circumferential bars along the length of the absorbent sleeve.

8. The device of claim 1 wherein the adhesive portions are placed in one or more generally helical strips along the absorbent sleeve.

9. The device of claim 1 wherein the adhesive portions are placed in linear strips generally parallel to the axis of the inner tube.

10. The device of claim 1 wherein the absorbent sleeve is a light color sufficient to allow prior use to be determined.

11. The device of claim 10 wherein the light color is white.

12. A device for removing hazardous liquid from an operating room floor comprising:

a. A vacuum source;

b. A flexible inner tube with two ends having a series of openings along its length and connected to the vacuum source at one end;

c. A plug closing the inner tube at the other end;

d. A porous covering on the outside of the flexible inner tube;

e. A contact-sensitive area on the outside of the porous covering for holding the device on the floor in the proximity of the liquid.

13. The device of claim 12 wherein the contact sensitive area is a series of adhesive strips around the circumference of the porous covering.

14. The device of claim 12 wherein the series of openings are radial perforations.

15. The device of claim 12 wherein the contact-sensitive area is a coating of adhesive applied to the outside of the porous covering.

16. A method of removing fluid from a horizontal surface comprising the steps of:

a. Providing a flexible generally linear device comprising a flexible inner tube with two ends having a plurality of perforations along its length, connected at one end to a vacuum source, an absorbent sleeve surrounding the inner tube and having adhesive portions on the outer surface thereof for contact with the horizontal surface;

b. Providing a closure at the end of the tube not connected to the vacuum source;

c. Activating the vacuum source to draw fluid into the sleeve and the inner tube for removal from a horizontal surface.

17. The method of claim 16 comprising the additional steps of a. Surrounding the fluid with the device to form a containment area;

b. Moving the device to change the containment area.

18. The method of claim 17 wherein the step of moving comprises decreasing the size of the containment area.

19. The method of claim 17 wherein the step of moving comprises drawing the containment area closed by pulling the ends of the device together.

20. The method of claim 16 comprising the additional step of dispensing a length of device from a storage location.

21. The method of claim 16 wherein the storage location is a roll.

22. The method of claim 16 further comprising the step of surrounding the fluid with a series of passes of the device to form a redundant containment area.

23. The method of claim 22 wherein the passes are generally concentric.

* * * * *